United States Patent [19]

Evans

[11] Patent Number: 4,927,133

[45] Date of Patent: May 22, 1990

[54] ANGLED CONVEYOR FOR DOCUMENT PACKAGES

[75] Inventor: David W. Evans, Alpha, N.J.

[73] Assignee: Bell & Howell Company, Skokie, Ill.

[21] Appl. No.: 248,458

[22] Filed: Sep. 23, 1988

[51] Int. Cl.[5] ..... B65H 5/02

[52] U.S. Cl. ..... 271/225; 198/416; 271/184

[58] Field of Search ..... 271/225, 184, 185; 198/416

[56] References Cited

U.S. PATENT DOCUMENTS 3,946,879 3/1976 Jensen ..... 271/185 X 4,085,839 4/1978 Crawford ..... 198/416 X

*Primary Examiner*—Richard A. Schacher

[57] ABSTRACT

An angled conveyor for document packages comprises a transition conveyor belt, having an angled direction of motion relative to the direction of feed of document packages to the transition conveyor belt, and an output conveyor belt in line with and having a direction of motion that is substantially the same as the motion of the transition conveyor belt. Conveyor belts are of the endless type having their upper surfaces disposed substantially in the same horizontal plane. The transition conveyor belt is disposed laterally adjacently to the downstream end of a feed conveyor. A post extends from the apparatus frame structure vertically upward through a gap between the upstream end of the output conveyor belt and the downstream end of the transition conveyor belt in a transversally adjustable position. The post protrudes above the upper horizontal belt surfaces by a distance that is at least equal to the thickness of document packages conveyed. Different positioning of the post establishes different orientation and location of document packages (conveyed through the angled conveyor) on the output conveyor belt.

10 Claims, 2 Drawing Sheets

ANGLED CONVEYOR FOR DOCUMENT PACKAGES

This invention relates to apparatus and method for conveying document packages and, in particular, it relates to conveyor devices providing angled transport paths for flat materials in a substantially horizontal plane.

Many present mechanical devices for quantity-handling of mail and mail-related sheet material items, as for instance envelopes, letters, packages and the like utilize conveyors for transporting such items singly to, from, and between processing locations of respective handling equipment. It is often necessary or expedient to angle the transport path, particularly in a rectilinear manner in the horizontal plane, while ensuring specific pre-established orientation of conveyed items. Existing mechanism to perform such angled conveying have been unreliable, particularly in regard to ensuring adequate repeatability of item orientation and location on the conveyor, especially when applied to high speed and high volume use. Relative complexity of such mechanisms has further hindered broader adoption. Moreover, the need for quick and simple adjustability of orientation and location of the items on an angled conveyor, as demanded by more exacting requirements of high-speed handling, has further increased complexity. In view of such problems, designs have favored avoidance of angled transport paths to the detriment of compactness, increased freedom from special restraints, and improved equipment performance.

For instance, U.S. Pat. No. 4,314,644 to Stocker shows a mail conveying device wherein mail items exit the device on a conveyor belt in an orthogonal direction with respect to the direction of mail feed to the device, while absolute orientation of the mail items remains unchanged. Transverse location of the mail items between discrete locations on the output conveyor belt is selectable.

In view of the foregoing, it is an object of the present invention to provide apparatus and method for conveying seriatim individual document packages at high speed on a substantially horizontal conveyor along an angled transport path while causing attainment of a predetermined orientation and transverse location of the document packages on the conveyor.

It is a further object of the present invention to provide apparatus and method for conveying seriatim individual document packages at high speed on a substantially horizontal conveyor along an angled transport path that provides for simple and easy preselection and preadjustment of a specific orientation and transverse location for the document packages upon leaving the angled transport path.

SUMMARY OF THE INVENTION

In accordance with principles of the present invention, document packages are transported seriatim along a substantially horizontal transport path that angles approximately 90 degrees, but that may be arranged to angle substantially more or less. Document packages enter the angled conveyor device with their longest dimension substantially lined up with the direction of motion of the feed conveyor belt that carries them. The packages are fed onto an adjacent transition conveyor whose direction of motion is angled in the desired direction of the output motion of the conveyor device. The relative motion between these two conveyor belts causes transitional angular reorientation of the package in the direction of motion of the transition conveyor belt up to the time when substantially the entire package is carried upon the transition belt. The package is thereafter conveyed in this orientation toward the downstream end of the transition conveyor belt.

A rigid post (turn post) extends vertically through a narrow gap between the transition conveyor belt and an output conveyor belt (both belts being substantially in line and having substantially the same direction of transport motion). The post protrudes above the upper horizontal belt surfaces by a distance that is at least equal to the thickness of the document packages handled. The general transversal location of the post in the gap establishes the desired direction of reorientation of the package in the course of the passage through the angled conveyor device. The exact transversal position of the post establishes the final location of the package on the output conveyor. The post location is transversally adjustable.

As the package is moved toward the downstream end of the transition conveyor belt and thusly over the gap between the transition belt and the output belt, it contacts the post at a point along its leading and registering edge and is stopped thereby at this point of contact. Depending on the location of this point of contact in relationship to the conveyor-caused driving forces acting on the document package, the package pivots about the post in one or the other direction of rotation. The package rotates now to an orientation approximately in line with the direction of the conveyor belt motion and slides then along the post entirely onto the output conveyor belt with its registering edge in a transverse location on the belt that is thusly established by the transverse position of the post.

The transverse position of the post is adjustable not only to preselect the desired direction of reorientation of the document package, but also to establish a particular final transverse location of the package on the output conveyor belt. The latter facilitates further processing of the package. The capability for preselection of one or the other direction of reorientation of the package allows a choice to be made between having a package exit the angled conveyor device in the same or reverse relative orientation to the conveyor belt transport motions. The orientation preselectability and the location adjustability are of rather significant important to further processing of document packages.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
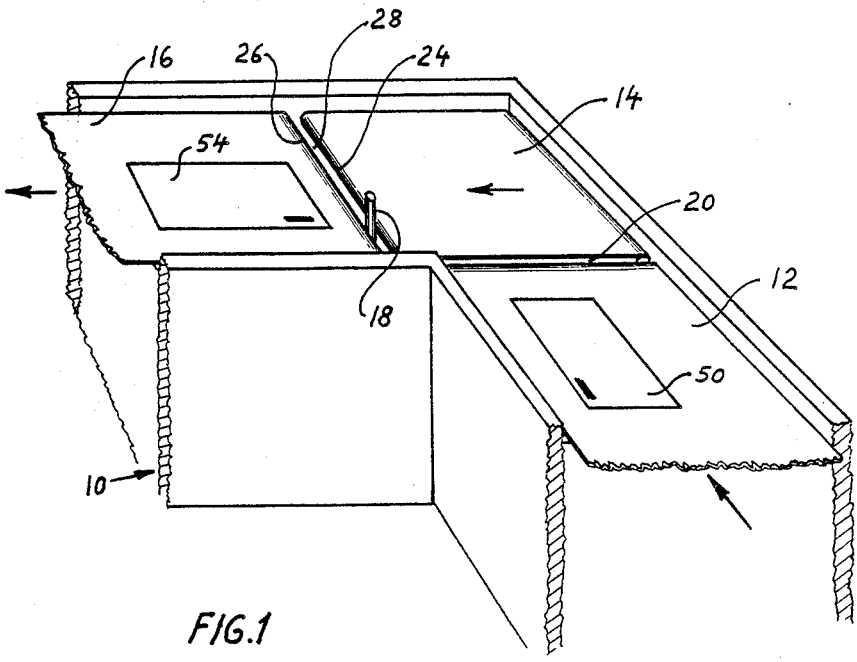
FIG.1 is a schematic isometric view of an angled conveyor device according to principles of this invention.
Figure 2:
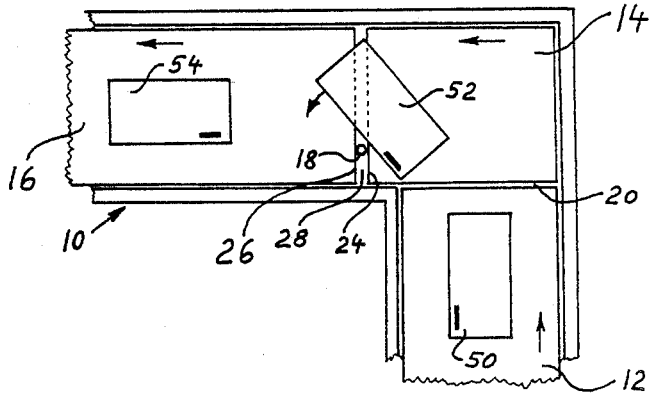
FIG. 2 is a schematic plan view of the angled conveyor device according to principles of this invention.

Referring to the drawings, numeral 10 designates the frame structure of the angled conveyor device. As shown in FIGS. 1 and 2, frame structure 10 is substantially in form of an L-shaped table on whose upper surface three powered endless belt conveyors are disposed in a substantially horizontal plane; namely, feed conveyor belt 12; transition conveyor belt 14, and output conveyor belt 16. The direction of motion of the belts is indicated by arrows.

The L-shaped table and the feed conveyor 12, as illustrated, are shown in this combination for clarity's sake only. Fundamentally, the present invention concerns transition conveyor belt 14 and output conveyor belt 16, whereby any other suitable form of document package feed onto transition conveyor belt 14 in a manner in accordance with the description herein is practical. Therefore, fundamentally, frame structure 10 need not include (or have disposed upon it) a provision for feeding of document packages. Thus basically, structure 10 need be only in form of a rectangular table and a suitable document package feed, in the general manner herein described, is provided separately.

Output conveyor belt 16 and transition belt 14 are disposed in-line and their motions are in the direction from the transition conveyor belt 14 to the output conveyor belt. Feed conveyor 12 is arranged substantially orthogonally to the transition conveyor belt. Feed conveyor 12 moves toward transition conveyor belt 14. Feed conveyor belt 12 and transition conveyor belt are spaced apart by a minimal clearance width indicated as feed gap 20. Feed gap 20 may be in form of a parallel-sided gap, as shown, but it may also be angled by a small angle to result in more or less than 90 degrees between the directions of motion of belts 12 and 14.

The downstream transition end 24 of transition conveyor belt 14 is spaced from the upstream input end 26 of output conveyor belt 16 by a transition gap 28. Transition gap 28 is shown parallel-sided, but may also be angled by a small angle to result in more or less than zero degrees between the directions of motion of belts 14 and 16.

Figure 3:
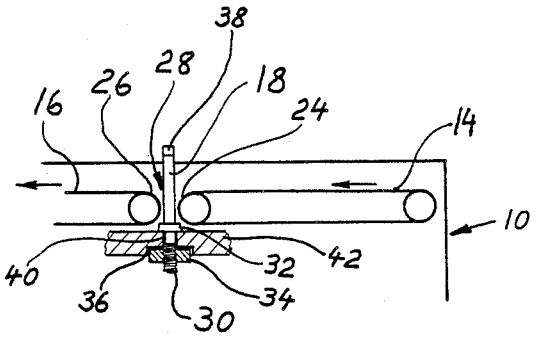
FIG. 3 is a schematic fragmental elevational view (of a portion of the angled conveyor device shown in FIGS. 1 and 2) in a vertical sectional plane that is in line with the motion of transition and output conveyor belts and that passes through the turn post.

A turn post 18 extends vertically through transition gap 28 and protrudes above conveyor belts 14 and 16. Turn post 18 is adjustably mounted on appropriate members of frame structure 10 below conveyor belts 14 and 16. The location of turn post 18 along transition gap 28 is adjustable to any position within the length of transition gap 28. For instance, as indicated in FIG. 3, turn post 18 is a cylindrical bolt having a shoulder 32 and a lower threaded end 30 that passes through a slot 40 in frame member 42. Slot 40 is disposed in line with and extends substantially along the length of transition gap 28. The lower face of frame member 42 is provided with a parallel slideway 36 (in line with slot 40) in which a threaded slide 34 is free to slide irrottationally along the length of slot 40. Threaded end 30 of turn post 18 is screwed into threaded slide 34 and, when screwed in tightly, grips frame member 42 between shoulder 32 and slide 34. Turn post 18 is thusly securely held in a particular location along gap 28. A gripping means 38, for instance in form of flats arranged in the cylindrical periphery of the upper end of turn post 18 may be provided to facilitate tightening or loosening either manually or with the aid of a suitable wrench. Other conventional gripping means may be used instead. When threaded engagement is loosened, turn post may be slid and thusly adjusted to any desired location along the length of slot 40 (and gap 28).

It should be understood that the hereinabove described and shown mounting arrangement for turn post 18 is presented by example for clarification reasons only and any other suitable conventional arrangement may be used to serve the intended purpose. Alternate mounting and adjustment arrangements include mounting of turn post 18 directly to a selected one of a number of mounting locations in frame member 42, thusly providing for a plurality of preselectable positions along transition gap 28. Other alternative arrangements include a mounting of turn post 18 on a slide mechanism that is repositionable by a lead screw and hand-crank or handwheel. Conventional technology offers a multitude of appropriate choices for positioning and position adjustment either manually or via motor means. For example, electromotive, pneumatic or hydraulic positioning is also appropriate either for infinitely adjustable positioning or for positioning to discrete pre-established locations. Furthermore, such positioning may be performed during operation and under automatic control of the angled conveyor device to provide facility and flexibility in handling of differing document packages or of other operational characteristics.

The passage of a document package from a typical operative location and orientation on feed conveyor 12 to a subsequent operative location and orientation on output conveyor belt 16 is indicated in FIGS. 1 and 2 by a schematic outline of an incoming envelope 50 and an outgoing envelope 54. An intermediate location and orientation of a transiting envelope 52 is additionally indicated in FIG. 2. The locations and orientations of envelopes 50, 52, and 54, in this sequence, are representative of the locations and orientations attained by a single envelope or by consecutively fed envelopes in the course of transit through the angled conveyor device of this invention.

Incoming envelope 50 is carried on feed conveyor 12 in an uncritical transverse location with its longer dimension oriented substantially in line with the motion of feed conveyor 12. Outgoing envelope 54 is carried on output conveyor belt 16 in a specific transverse location and having its longer dimension oriented substantially in line with the motion of output conveyor 16. The orientation of outgoing envelope 54 in relation to incoming envelope 50 is substantially orthogonal, as a consequence of anticlockwise reorientation during envelope transit in the angled conveyor of this invention.

The direction of reorientation depends on the location of turn post 18 along transit gap 28. As shown in FIGS. 1 and 2, turn post 18 is located closer to the left-hand end of transit gap 28 (when viewed in the direction of conveyor belt motion). Consequently, outgoing envelope 54 is disposed in substantially the same orientation with respect to the direction of motion of output conveyor belt 16, as was its original orientation (represented by envelope 50) with respect to the direction of motion of feed conveyor 12.

If turn post 18 is adjusted to a location closer to the right-hand end of transit gap 28, the direction of reorientation will be anticlockwise and thusly the leading edge of an envelope fed to the angled conveyor device will become the trailing edge of the envelope after transit through the angled conveyor device.

More particular adjustment of location of turn post 18 (when it is generally disposed closer to either end of transit gap 28) establishes a specific transverse location of an outgoing envelope (envelope 54) on output conveyor 16.

In operation, document packages or envelopes are fed seriatim on feed conveyor 12 in uncritical transverse location and having at least one of the longer edges as the left edge (when viewed in direction of motion of conveyor 12) uncritically oriented generally in line with the direction of motion of conveyor 12. Whereas generally document packages of rectilinear (particularly rectangular) outlines are handled by the angled conveyor device of the present invention, it will be clearly apparent that the device is capable of handling document packages of other outlines, provided that the document has at least one straight horizontal edge that is not grossly shorter than any other edge and that is generally disposed on the left side (when viewed in direction of motion of conveyor 12) as it is fed on feed conveyor 12.

Feed conveyor 12 transfers a document package or envelope onto the angled transition conveyor 14 whose motion slideably reorients the envelope in direction of motion of conveyor 14 during this transfer operation. Once the envelope rests substantially entirely on transition conveyor belt 14, its orientation remains unchanged until its leading edge contacts stationary turn post 18. The envelope now pivots about and slides along turn post 18. Thusly, the envelope is reoriented and relocated in dependence on the location of post 18. Output conveyor belt 16 now transports the envelope with its edge that has just left contact with turn post 18 substantially in line with the direction of motion of output conveyor belt 16 in a transverse location with respect to output conveyor belt 16 that is determined by and substantially corresponds to the transverse contact point with turn post 18.

In uses of the angled conveyor of the present invention that require fast readjustment of the location of turn post 18 to a number of discrete positions, a number of axially displaceable turn posts may be arranged in appropriate fixed locations on frame structure 10 (below conveyor belts). Such posts may be selectively actuated, for example by selectively energized solenoids, such as to be pushed upward through gap 28 to protrude above upper belt surfaces and serve as hereinbefore described. The inactive turn posts are submerged below the upper surface of the belts.

Whereas conveyor belts 12, 14, and 16 are oriented substantially in a horizontal plane in the described preferred embodiment of the present invention, it will be clear that consecutive conveyor belts may have their transporting surfaces stepped down and that they need not necessarily be located in the same horizontal plane nor need the surfaces be exactly horizontal. For instance, particularly, feed conveyor 12 may feed onto transition conveyor belt from higher or lower elevations at considerable slopes without detriment to the described operation. Moreover, for example, feed conveyor 12 may be laterally tilted by a large amount up to being oriented almost vertically, as long as document packages are deposited appropriately onto transition conveyor belt 14 substantially as hereinbefore described.

As indicated hereinbefore, the angled conveyor device of this invention is not limited to rectilinear transport, but may be arranged to offer larger and smaller than 90 degree transport redirection by appropriately angled relationship between feed conveyor direction and/or by provision of an angled transition gap 28.

It should be noted also that turn post 18 may be appropriately provided with a freely revolvable outer cylindrical sleeve to facilitate ease of document package pivoting and sliding on its periphery.

In accordance with principles of the present invention, the angled conveyor device facilitates transport of document packages fed to it in non-critical alignment and coveys the document packages generally along a right angle path, while providing specific lateral position alignment and specific orientation in adjustable manner for the packages leaving the device. Aside from the utter simplicity of the device and its low-cost features, it provides reliable high-volume and high-speed performance. Moreover, increased freedom from spatial restraints and saving of space is offered in systems incorporating the device. Further advantages include the ease of adjustability of package location and orientation (respectively reorientation) and the ability to not only pre-establish, but also to change these parameters during operation under operational control. The flexibility thusly offered in different uses and for multi-task applications is clearly apparent.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A mailing machine including an angled conveyor device for document packages comprising:

first feed means for in-feeding of said document packages in seriatim;

a transition conveyor belt including a downstream transition end;

an output conveyor belt for seriatim outfeeding of said document packages, said output conveyor belt including an upstream output end;

a frame on which said belts are driveably mounted;

a transition gap disposed between said downstream transition end and said upstream output end;

turn post means extending substantially vertically upwardly through said transition gap and protruding above the upper surfaces of said transition and output conveyor belts, said turn post means serving to intercept and guide said document packages therearound so that said document packages become substantially aligned angularly and transversely on said output conveyor belt;

said transition conveyor belt having an angled direction of motion relative to the direction of motion of said document packages during in-feeding; and, said output conveyor belt having a direction of motion generally in line with the direction of motion of said transition conveyor belt.

2. A mailing machine in accordance with claim 1, wherein said turn post means is adjustably positionable along the length of said transition gap.

3. A mailing machine according to claim 1, wherein said turn post means is adjustably positionable to a plurality of discrete positions along the length of said transition gap.

4. A mailing machine according to claim 1, wherein said turn post means is infinitely adjustable to any position along the length of said transition gap.

5. The mailing machine of claim 1 including at least a second such turn post located in said transition gap; and, means for selectively causing at least a selected one of said turn posts to extend above said upper surfaces of said transition belt.

6. The mailing machine of claim 5 including solenoid means connected to each of said turn posts and means for selectively operating said solenoid means to selectively cause at least one of said connected turn posts to extend above said upper surface of said transition belt at a selected location in said transition gap.

7. A method of operating a mailing machine including the conveying of document packages in seriatim along a generally horizontal transport path so that said document packages become aligned angularly and transversely with respect to said transport path, said method comprising the steps of:

a. feeding said document packages, while having an edge thereof approximately in line with the direction of feed motion, onto a drive conveyor surface that is substantially horizontal and that has a general direction of motion that is normal to said feed motion;

b. transporting said document packages that have been fed onto said driven conveyor surface, by said driven conveyor surface toward an output transport conveyor that is substantially in line with said driven conveyor surface and that is separated therefrom by a gap;

c. intercepting said document packages by a vertical post located in said gap and protruding above both said driven conveyor surface and the surface of said output transport conveyor;

d. guiding said document packages around and along said vertical post onto said output transport conveyor so that said document packages become substantially aligned angularly and transversely with respect to and on said output transport conveyor in dependence on the position of said vertical post along the length of said gap; and, e. using said output transport conveyor to convey said document packages onward.

8. The method of claim 7 including the step of adjustably positioning said vertical post along the length of said gap.

9. The method of claim 7 including the step of adjustably positioning said vertical post at a selected point on one of a plurality of discrete positions along the length of said gap.

10. The method of claim 7 including the step of selectively adjusting said post to any one of an infinite number of positions along the length of said gap.

* * * * *